United States Patent [19]

Grönert et al.

[11] Patent Number: 4,951,490

[45] Date of Patent: Aug. 28, 1990

[54] METHOD FOR AUTOMATICALLY CONTROLLING SPINNING ROLLS

[75] Inventors: Heinz Grönert, Emmering; Manfred Eckert, Dachau, both of Fed. Rep. of Germany

[73] Assignee: Man Technologie GmbH, Munich, Fed. Rep. of Germany

[21] Appl. No.: 343,409

[22] Filed: Apr. 25, 1989

[30] Foreign Application Priority Data

Jun. 18, 1988 [DE] Fed. Rep. of Germany ..... 3820742

[51] Int. Cl.[5] ..... B21B 19/14

[52] U.S. Cl. ..... 72/9; 72/84; 72/110

[58] Field of Search ..... 72/8, 9, 75, 84–87, 72/83, 98–100, 110, 111

[56] References Cited

U.S. PATENT DOCUMENTS

| | | | |
|---|---|---|---|
| 1,610,593 | 12/1926 | Roeckner | 72/111 |
| 1,771,420 | 7/1930 | Roeckner | 72/111 |
| 2,034,132 | 3/1936 | Diescher | 72/98 |
| 2,042,552 | 6/1936 | Roeckner et al. | 72/98 |
| 2,305,794 | 12/1942 | Roeckner | 72/86 |
| 3,287,951 | 11/1966 | Widera | 72/370 |
| 4,766,752 | 8/1988 | Gronert et al. | 72/84 |

FOREIGN PATENT DOCUMENTS

| | | | |
|---|---|---|---|
| 3402301 | 1/1984 | Fed. Rep. of Germany . | |
| 184425 | 9/1985 | Japan | 72/98 |

*Primary Examiner*—Robert L. Spruill
*Attorney, Agent, or Firm*—Ladas & Parry

[57] ABSTRACT

A method for the automatic control of the setting of spinning rolls in relation to a cylindrical, tubular workpiece in an opposed roll spinning lathe with four pairs of rolls. Each of the four pairs of rolls consists of one inner roll and one outer roll each, of which is arranged on a holder on a carrier so as to be radially adjustable in relation to the workpiece and so that the pairs of rolls are arranged at equal circumferential spacing about the workpiece so that the roll pair acting as the first rolling stage is placed diametrically opposite the second roll pair operating as the second rolling stage, the roll pair operating as the third rolling stage is offset by 90° in relation to the first roll pair and is diametrically opposite the roll pair operating as the fourth rolling stage so that during the spinning rolling process the pairs of rolls and the workpiece perform a translatory and a rotary motion and furthermore the radial forces acting on the rolls are continuously measured. During the coming into working engagement with the workpiece and the stationary rolling process the radial forces occurring at like rolls whether (inner or outer) of the respectively oppositely placed roll pairs are compared with each other and if a permissible differential force is exceeded, the roll of the respective preceding roll stage is adjusted radially to compensate the lack of force equilibrium and simultaneously however the compared or reference roll is kept in a radial position corresponding to its initial basic value.

14 Claims, 9 Drawing Sheets

| Nr. | | | | | | | | |
|---|---|---|---|---|---|---|---|---|
| | 1/2 | 2/2 | 3/2 | 4/2 | 1/1 | 2/1 | 3/1 | 4/1 |
| | 4,5 | 9,0 | 13,5 | 17 | 4,5 | 9,0 | 13,5 | 17 |
| | 0 | 16 | 32 | 48 | 0 | 16 | 32 | 48 |
| -Ø | 580 | 580 | 580 | 580 | 520 | 520 | 520 | 520 |
| -Ø | 3000 | | | | 2910 | | | |

METHOD FOR AUTOMATICALLY CONTROLLING SPINNING ROLLS

BACKGROUND OF THE INVENTION

The invention relates to a method for the automatic control of the setting of spinning rolls in relation to a cylindrical, tubular workpiece in an opposed roll spinning lathe with four pairs of rolls. More specifically, the invention relates to a method in which each of the four pairs of rolls consists of one inner roll each and one outer roll, of which is arranged on a holder on a carrier so as to be radially adjustable in relation to the workpiece and so that the pairs of rolls are arranged at an equal circumferential spacing about the workpiece with the roll pair acting as the first rolling stage placed diametrically opposite the second roll pair operating as the second rolling stage, and with the roll pair operating as the third rolling stage offset by 90° in relation to the first roll pair and diametrically opposite the roll pair operating as the fourth rolling stage so that during the spinning rolling process the pairs of rolls and the workpiece perform a translatory and a rotary motion. Furthermore the radial forces acting on the rolls are continuously measured.

The invention takes as its starting point an opposed roll spinning lathe in accordance with the German pre-examination specification 3,545,506, and its equivalent U.S. Pat. No. 4,766,752 which operates with four pairs of rolls consisting respectively of an inner roll and an outer roll each of which is arranged radially adjustably in relation to the work on a holder secured to a carrier. The four pairs of rolls are evenly arranged about the circumference of the work and the roll pair forming the first rolling stage is diametrically opposite the second roll pair stage while the third roll pair stage is spaced by 90° from the first and second roll pairs with the fourth roll pair diametrically opposite it. In this design of spinning and rolling lathe both the work drive and also the guides and feed drives of the inner and outer spinning roll carriers are arranged on the same side of the lathe and accommodated spatially on the foundation. The inner and outer spinning roll carriers are not connected with each other at the top end so that a substantial length of the tubular workpiece is free during spinning and is able to "grow" out of the spinning lathe in an upward direction. This type of spinning lathe is used for the spinning of tubes with a substantial diameter and length, the diameter of a tube to be produced being for instance of the order of three meters. In the case of such cold working to produce such tubes, extremely high rolling forces are required at the spinning rolls, for instance of the order of 300 to 2000 kN. It generally proves to be extremely difficult to apply such forces by means of cantilever roll carriers. Errors in computing and setting the working parameters of unforeseen events may quickly lead to severe damage to the spinning lathe.

SUMMARY OF THE INVENTION

Accordingly one object of the present invention is to devise a method for the automatic control of the spinning rolls in relation to a tubular, cylindrical workpiece in the case of an opposed roll spinning lathe of the initially mentioned type, which method is able to very reliably prevent the occurrence of excessive working forces which might lead to damage to the lathe.

In order to achieve this or other objects appearing from the present specification, claims and drawings, during the coming into working engagement with the workpiece and during the stationary rolling process the radial forces occurring at like rolls of the respectively oppositely placed roll pairs are compared with each other and if a permissible differential force is exceeded, the roll of the respective preceding roll stage is adjusted radially to compensate the lack of force equilibrium and simultaneously however the compared or reference roll is kept in a radial setting corresponding to the set basic value.

Further features and advantages of the invention are described hereafter referring to the accompanying drawings which show one working embodiment thereof.

DETAILED DESCRIPTION OF A WORKING EMBODIMENT OF THE INVENTION

Figure 1:
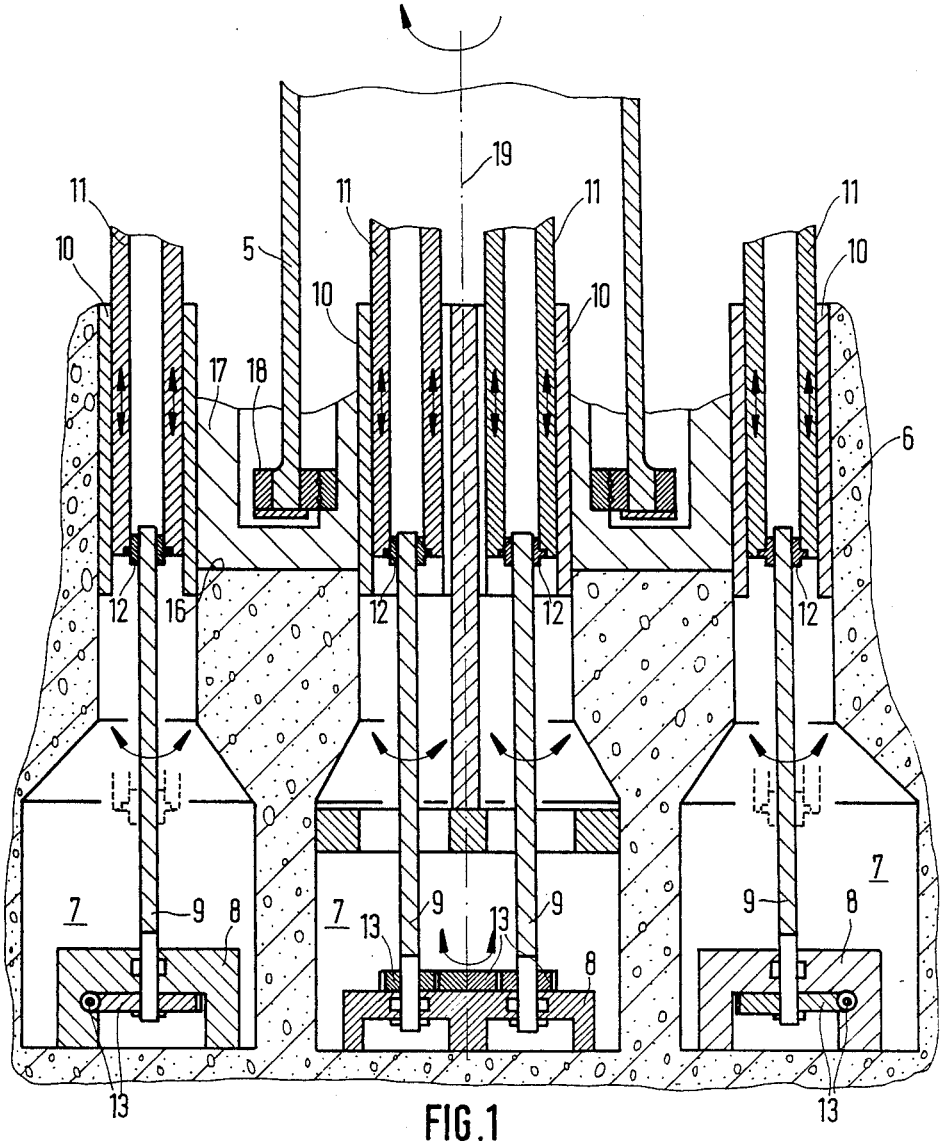
FIG. 1 shows, in section, the lower part of an opposed roll spinning lathe.

The opposed roll spinning lathe shown in the figures by way of example only has four roll pairs 1, 2, 3 and 4, which are used to cold work a tubular, cylindrical workpiece 5 by spinning. Each roll pair 1, 2, 3 and 4 consists of an inner roll 1/1, 2/1, 3/1 and, respectively, 4/1 acting on the inner face of the workpiece 5 or blank and an outer roll 1/2, 2/2, 3/2 and, respectively, 4/2 acting on the outer face of the workpiece 5. The workpiece 5 to be rolled or spun is relatively large and has a diameter of several, meters for instance.

The spinning lathe is arranged on a foundation or support structure 6, in which vertical passages or cavities 7 are formed in whose lower part abutments 8, fixed to the floor for instance, are provided for threaded rods 9 which are rotatably mounted in such abutments and are able to be driven. In the upper part of the cavities 7 there are plain bushings 10 each of which serves for guidably supporting a tubular column 11 which is able to be axially moved in the bushing. Each of these columns 11 is connected via a terminal drive head 12 with the respective threaded rod 9 so that when the latter is turned the column 11 may be reciprocated in the axial direction as indicated by the arrows. The drawing shows only one drive 13 or parts thereof for driving the threaded rods 9. The respective drive motors have been omitted from the figures to simplify them. The inner four columns 11/1, 11/2, 11/3 and 11/4 form—as will be seen from FIG. 2—the inner roll carrier together with a head part 15. On the end face 16 of the carrier structure or, respectively, of the foundation 6 there is an abutment 17 for a holder 18 which is suitably supported and secured so that it may be used to clamp and drive the workpiece 5 in the opposed roll spinning lathe. The abutment 17 may also constitute the holder, at least for the plain bushings 10 of the columns 11/1, 11/2, 11/3 and 11/4 of the inner roll carrier. The holder 18 may for instance by made up of a plate which is axially fixed but may be caused to rotate by means of a drive which is not shown. The workpiece 5 may be held on the plate by suitable clamping members so that the workpiece is centered on the axis 19 of rotation.

The head part 15 of the outer roll carrier consists of a massive annular member, which in plan is generally square, and which has a roll holder 20 at each of its corner parts. An outer roll 1/2, 2/2, 3/2 and, respectively, 4/2 is indirectly journaled at each of the four roll holders 20. For details of the journaling or bearing means, see FIGS. 2, 3 and 7. The roll holders 20 are formed by blocks which are mounted in an axially adjustable manner in the head part 15 in suitable transverse holes while at the same time being prevented from rotating. For a preliminary anchoring effect on each roll holder 20 in different radial positions of adjustment in relation to the workpiece 5 which is to be spun, there are holes 24 which extend in the head part 15 in a direction perpendicular to the axis of adjustment of the roll holder. These holes 24 have halves 22 adjacent to the roll holder 20 and further hole halves 23 in the roll holder 20. In these holes 24 and in combined hole halves 22 and 23, which are combined to form extensions thereof, a suitable securing rod may be placed. In this respect it is a question of coarsely adjusting the roll carrier 20; the radial accurate adjustment for the outer roll carried thereby in relation to the work 5 to be spun is produced by a suitable means such as a wedge adjusting mechanism, the details of which will be seen in FIG. 3.

The head part 14 of the inner roll carrier consists of a massive member, which is also generally square in its basic form which also carries a roll holder 25 at each of its corner parts. On the roll holder 25 a respective inner roll 1/1, 2/2, 3/1 and, respectively, 4/1 is mounted. The roll holders 25 are arranged in the same manner on the head part 14 so that in this respect there are the same features and no separate reference numerals are needed.

Figure 2:
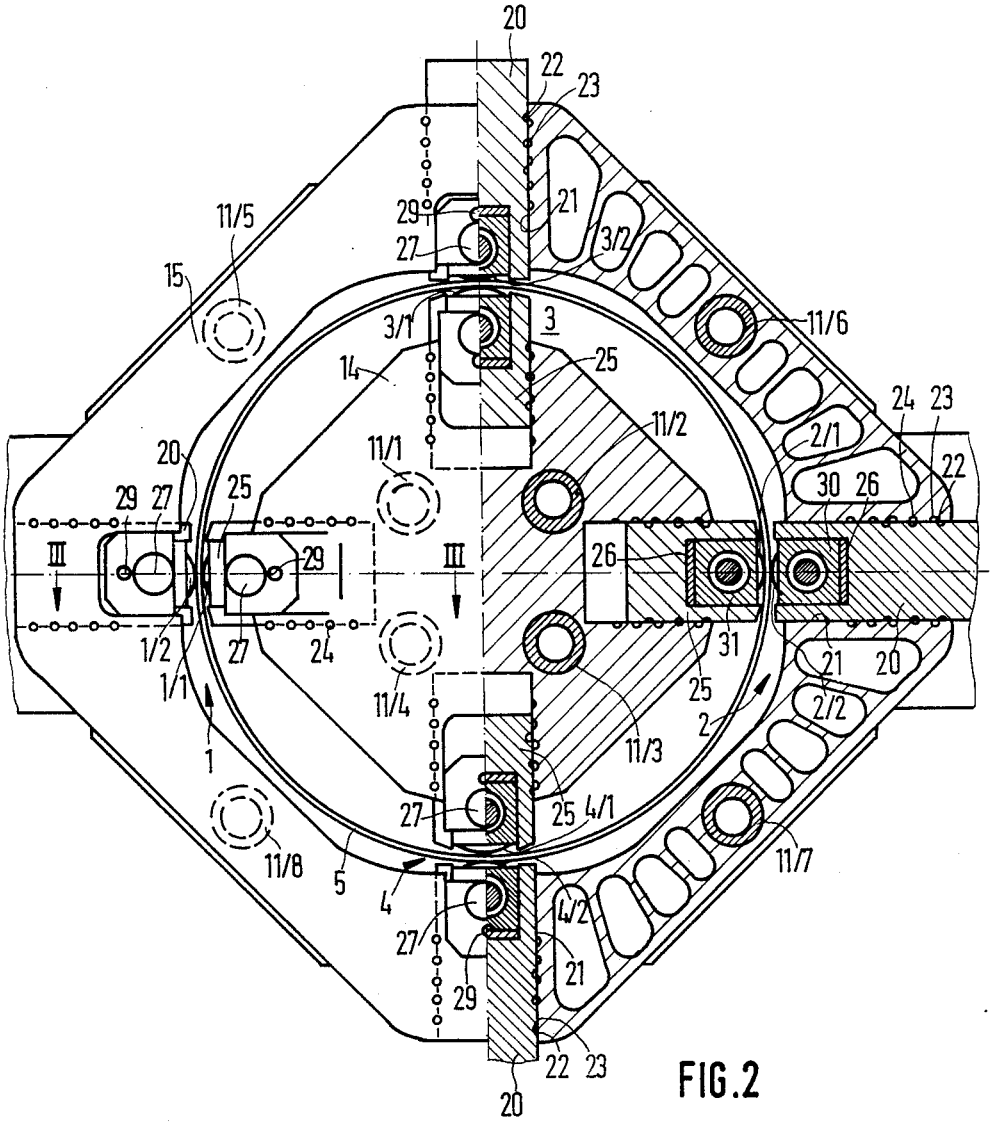
FIG. 2 shows, in section, the upper part of the opposed roll spinning lathe in FIG. 1.
Figure 3:
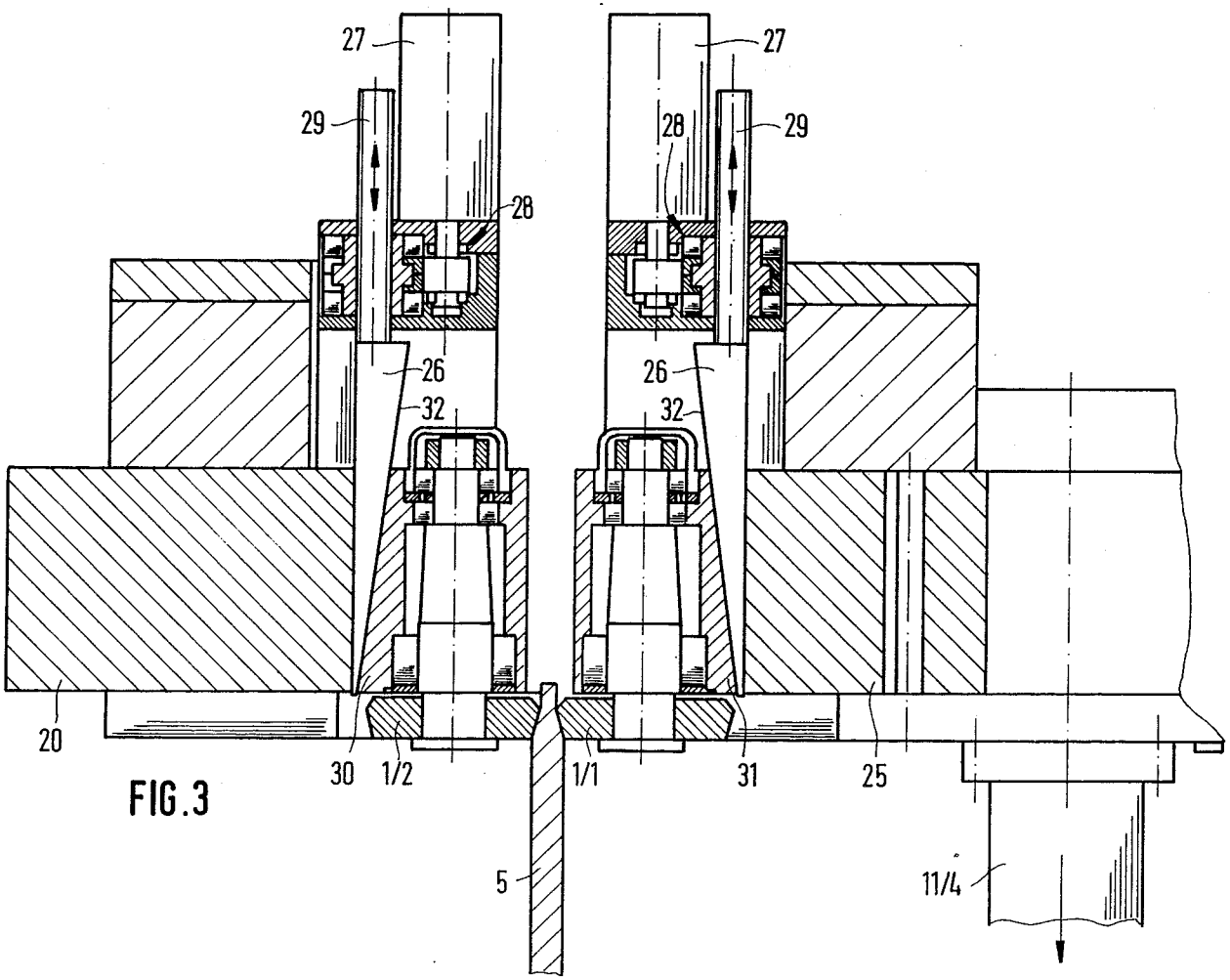
FIG. 3 shows a detail of the lathe in section on line III—III in FIG. 2 on a larger scale.

FIG. 3 shows a cross section in more detail taken through a pair of rolls, namely the rolls 1/1 and 1/2 of FIG. 2 in order to indicate the mechanism for the radial fine adjustment of the rolls in relation to the workpiece, 5 which is to be spun, using a wedge 26. After the outer roll 1/2 and inner roll 1/1 of the roll pair 1 has been moved approximately in the desired position by means of the associated roll holder 20 and, respectively, 25, for fine setting a drive motor 27 is started, which is mounted on the respective roll holder 20 and, respectively, 25 so that by way of a transmission 28 a threaded rod 29 is moved in the one or the other direction axially as indicated by the arrow. This moves the wedge 26, which is secured to one end of the threaded rod 29, more or less into or out of a wedge gap between the roll holder 20 and, respectively, 25 and a relatively sliding bearing member 30 and, respectively, 31. In the said bearing member 30 the outer roll 1/2 is journaled, whereas the inner roll 1/1 is journaled in the said bearing member 31. The bearing member 30 and, respectively, 31 and the wedge 26 with the threaded rod 29, the transmission 28 and the drive motor 27 are components of a roll holder 20 and, respectively, 25.

During coarse adjustment the entire roll holder 20 and, respectively, 25 is displaced while during fine adjustment the inclined plane 32 of the wedge 26 only causes a transverse motion of the bearing member 30 and, respectively, 31 which has a matching wedge-like surface, towards the workpiece 5 so as to be forced against it. On withdrawing the wedge 26 out of the wedge gap, springs or the like, not shown, cause the bearing member 30 and, respectively, 31 to be moved away from the workpiece 5 again.

This adjustment system offers advantages inasmuch as it is not only simple and makes possible very accurate radial adjustments but furthermore is able to take up high spinning forces. The most significant spinning force component is in the radial plane and only has to be transmitted by the wedge 26. The axial component caused by the inclined plane 32 at the wedge 26 is negligibly small.

The drive motors 27 are operated by an automatic controller which is not shown.

The four roll pairs 1, 2, 3 and 4 form four rolling stages, that is to say the individual roll pairs are offset in the axial direction on the head parts 14 and 15 of the two roll carriers by given amounts which are preferably equal to the amount a. The arrangement of the roll pairs is as follows: the roll pair 1/1 and 1/2 acting as the first roll rolling stage is diametrally opposite to the roll pair 2/1 and 2/2 acting as the second roll stage. The roll pair 2/1 and 2/2 is axially offset from the roll pair 1/1 and 1/2 by the amount a. The roll pair 3/1 and 3/2 acting as the third rolling stage is axially offset from the roll pair 2/1 and 2/2 by the amount a and circumferentially is offset by 90° from the roll pair 2/1, 2/2 or 1/1 and 1/2 and is furthermore arranged so as to be diametrally opposite to the roll pair 4/1 and 4/2 acting as the fourth rolling stage. The roll pair 4/1 and 4/2 is offset by the distance a axially from the roll pair 3/1 and 3/2.

In operation the high forces with which the rolls of the roll pairs 1, 2, 3 and 4 are pressed against the wall of the workpiece 5 are favorably directed so that the forces may be completely taken up by the head parts 14 and 15 and the columns 11 are hardly loaded at all. Furthermore, these four roll pairs make it possible to produce very long tubes from relatively thick-walled and short tubular workpieces 5 since four stretching stages take place in one working operation.

It will be seen from the arrangement as described above that the placing of the tool parts of the spinning lathe at the end at which the workpiece 5 is also clamped in position means that there are practically no limits to the length to which a tube may be rolled.

For the rolling or spinning operation the first step is for the workpiece 5 to be clamped in the holding means 18. Furthermore the outer and inner roll carriers are axially set in a suitable starting position in accordance with the length of this workpiece 5. The starting position may be such that the roll pair 1/1 and 1/2 operating as the first rolling stage is placed a small distance short of the free outer end of the workpiece 5. Preferably the axial position of the roll pairs 1, 2, 3 and 4 is however as in FIG. 4 or FIG. 5A, as will be described in more detail below. After this the coarse and fine adjustment of the rolls is performed. Such adjustment is in accordance with the desired depth of rolling and the thrusts produced. These parameters are themselves then in turn controlling for the peripheral speed at which the workpiece 5 is driven in the holding means 18, and the feed speed for the two roll carriers. The rolls of a pair of rolls pressed towards each other causes a stretching of the wall of the workpiece 5. The rolls of a roll pair equally divide the work performed on the workpiece. The two rolls of a roll pair only dig into the work by half the amount as compared with a case in which there would be a single roll in place of a pair thereof.

During the rolling process extremely high thrusts are developed at the rolls which may for instance be of the order of 300 to 2000 kN. It is somewhat complex to divide the thrusts equally so that they are taken up by the freely projecting or cantilever roll carriers. The spinning roll thrusts are calculated in advance and in accordance with such calculation the rolls are set with respect to depth of rolling and also the peripheral speed of the workpiece 5 and the feed speed for the roll carriers with the rolls. Errors in the calculation and setting of the lathe in accordance with the working data or other accidental events have in the prior art quickly led to substantial damage to the lathe and in order to avoid such damage the spinning lathe in accordance with the invention is equipped with an automatic control system, which makes it possible for the spinning rolls to be operated in a novel manner.

This automatic control is such that during insertion into the workpiece 5 and during stationary spinning i.e. when the rolls have reached their initially set machining positions, the radial forces occurring at similar rolls (similar in the sense of being internal or external) of the mutually diametrically opposite arranged pairs of rolls are measured and compared with each other and when a permissible differential force is exceeded the roll of the respective preceding rolling stage is radially reset in a manner to compensate the lack of equilibrium of forces. At the same time however the roll whose force has been compared is kept to a radial position corresponding to the set basic value, that is to say, at the set depth of rolling.

Furthermore if a preset automatic control limit is exceeded, the feed rate, on which the axial relative motion between the workpiece 5 and the spinning rolls dependent is reduced or, if necessary, the working process is interrupted.

In addition to this balancing of the metal working forces the automatic control system additionally ensures that the wall thickness and the diameter of the spun workpiece are kept constant.

As regards details this means that during automatic control:

1. The radial thrusts effective between the outer rolls 1/2 and 2/2 continuously or intermittently measured by suitable measuring devices and methods, of the two oppositely placed pairs 1 and 2 of rolls are compared with each other and furthermore the radial forces between the outer rolls 3/2 and 4/2 of the two oppositely placed pairs of rolls 3 and 4 are compared, and 2(a). when the differential force established as a set point in the automatic control system as a permissible value, at for instance 50 kN, between the outer rolls 1/2 and 2/2, the outer roll 1/2 of the first roll pair 1 is radially reset in a manner compensating the lack of equilibrium, that is to say the depth of rolling is reduced, but the outer roll 2/2 serving as a reference roll of the second roll pair 2 is kept at the previously set basic value in accordance with the preset depth of rolling, and (b) on exceeding the differential thrust previously set for the automatic control system, of for instance 50 kN, between the outer rolls 3/2 and 4/2, the outer roll 3/2 of the third roll pair 3 is radially reset in a manner overcoming the lack of thrust equilibrium, but in this case the outer roll 4/2, serving in this case as a reference roll, of the fourth roll pair 4 is kept at the originally set value in accordance with the desired external diameter of the tube as spun.

It is however also possible, independently of the thrusts at the outer rolls 3. to compare the radial forces, which are measured by suitable measuring devices and methods continuously or intermittently, between the inner rolls 1/1 and 2/1 or, respectively, 3/1 and 4/1 of oppositely placed roll pairs 1 and 2 and, respectively, 3 and 4, and 4(a). when the differential thrust, of for instance 50 kN, between the inner rolls 1/1/ and 2/1 as taken into account by the automatic control system as being the permissible limit, is exceeded, to reset the inner roll 1/1/ of the first roll pair 1 in a radial direction to compensate the lack of thrust equilibrium, that is to say, to decrease the depth of rolling while nevertheless keeping the inner roll 2/1, functioning as the reference roll, of the second roll pair 2 at the preset basic value, and (b). when the differential force, of for instance 50 kN, between the inner rolls 3/1 and 4/1 as taken into account by the automatic control system as being the permissible limit is exceeded, to reset the inner roll 3/1 of the third roll pair 2 radially in a manner such as to correct the lack of thrust equilibrium, that is to say to decrease the depth of rolling, but in this case to keep the inner roll 4/1, serving as the reference roll, of the fourth roll pair 4 at the guide or datum value corresponding to the desired internal diameter of the tube to be rolled.

As an alternative to the mutually interdependent control procedures as indicated in parrs 1, 2(a), 2(b) or 3, 4(a) and it is also possible to apply the two methods simultaneously.

The differential thrust control teaching makes it possible to automatically equalize the surprisingly high forces which arise at the individual rolls, for instance owing to the formation of beads in front of the rolls. In addition to this differential force control the automatic control system will also have a control limit value for the maximum thrust allowed for each roll, whereby any excessive radial thrust at one or all the rolls will be countered by a reduction of the feed rate which is controlling for the axial relative motion between the workpiece and the roll carriers. Furthermore the automatic control will also hold a limit exceeding the maximum thrust value, of for instance 100 kN as a second limit, so that when the latter is exceeded the entire rolling operation will be interrupted.

Excessive radial thrusts at the individual rolls may thus be countered either automatically or possibly by manual modification of the programmed course of working of the tube material.

A more detailed description will be given of the individual control steps in the invention during feed and motion of the rolls into the workpiece 5 and then during stationary operation of the spinning operation with reference to FIGS. 4 and 5A to 5H.

Figure 4:
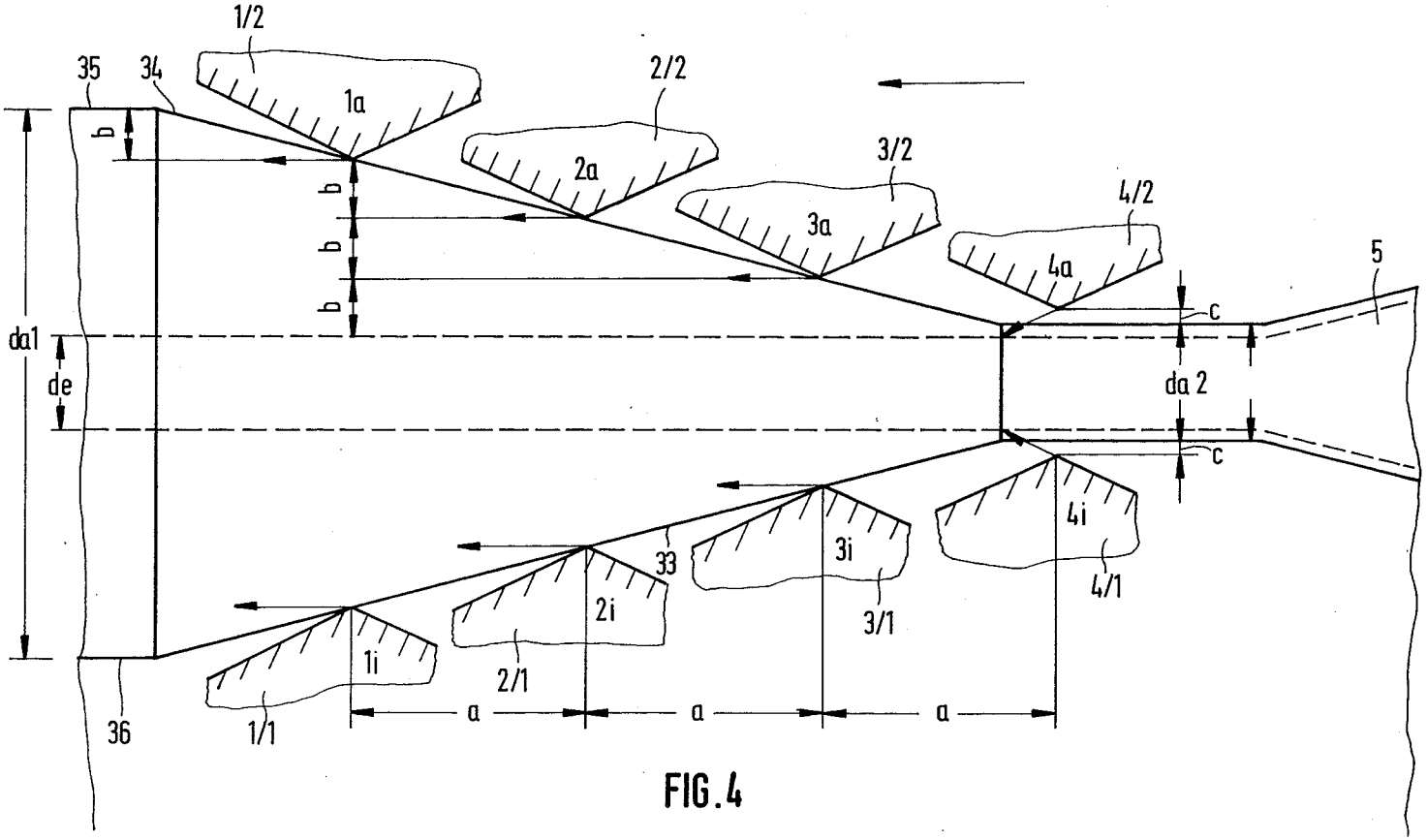
FIG. 4 shows the initial axial location of the four roll pairs of the opposed roll spinning lathe as applied to a tubular, cylindrical workpiece, which has been previously turned on a lathe.

FIG. 4 shows a workpiece 5, which at its free end has a previously turned inwardly directed taper with a conical inner face 33 and a conical outer face 34. The slope of these conical surfaces 33 and 34 is such that the inner and outer rolls of the first three roll pairs 1, 2 and 3 with respectively the same mutual axial clearance a and the same mutual radial clearance b simultaneously working contact with the surfaces 33 and 34 when axially approaching the work. The wall thickness of the workpiece 5 following the initial taper is denoted $d_{a1}$ and preceding the initial taper it is denoted $d_{a2}$. $d_e$ denotes the desired wall thickness at the end of rolling. The rolls 1/1 and 1/2 of the first roll pair 1 are set so as to be radially offset by the amount b in relation to the diameter of the outer face 35 of the wall and, respectively, the inner face 36 of the wall of the workpiece 5. The rolls 4/1 and 4/2 of the fourth pair of rolls with the same distance corresponding to the distance of the other rolls 1, 2 and 3 from the third roll pair 3 are initially not set to the same amount b as the rolls of the other roll pairs but are set to a position in which they are spaced at a distance c (of about 1.0 mm) from the workpiece 5. This feature is a convenient way of precluding damage to the surface when moving the rolls 4/1 and 4/2 of the fourth roll pair 4 into engagement. Furthermore it is an advantage if the third roll pair 3/1 and 3/2, which is automatically controlled by the differential thrust, comes into engagement with the initial taper and contacts the workpiece prior to the fourth roll pair 4/1.

Figures 6, 7:
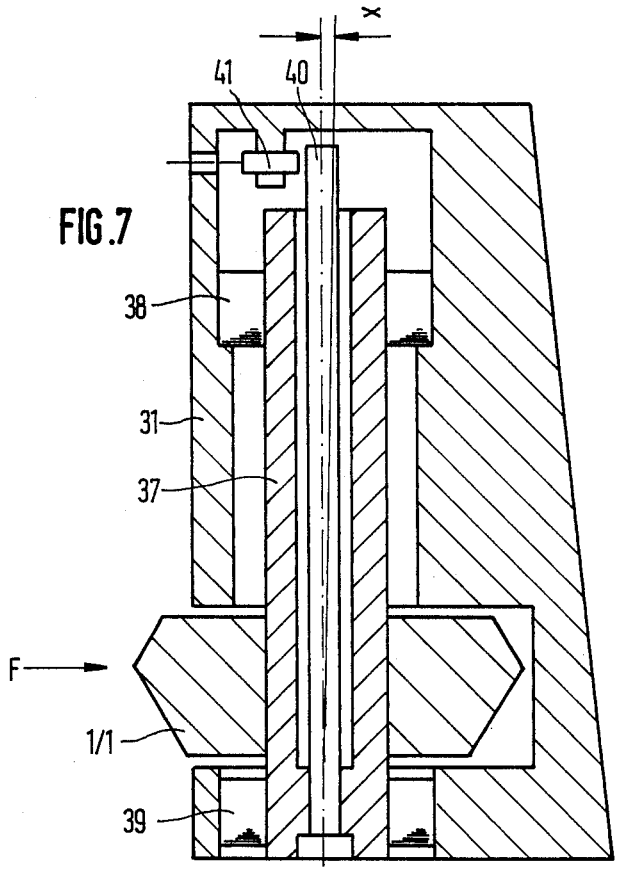
FIG. 6 is a data table.
FIG. 7 shows a section through part of a roll holder in order to explain a preferred method of measuring radial forces, FIG. 8 diagrammatically shows an automatic control system.

The radial feed amounts and the axial roll spacings for initial working tests are indicated in the table of FIG. 6 for a workpiece 5, selected as an example, with an external diameter of 3000 mm and an internal diameter of 2910 mm. Reference points for the radial feed amounts are the outer cylindrical surface 35 and the inner cylindrical surface 36 of the workpiece 5. The axial distance amounts are counted starting with the fourth roll pair 4/1 and 4/2. The axial distances a are able to be set, for instance by using shims.

Figure 8:
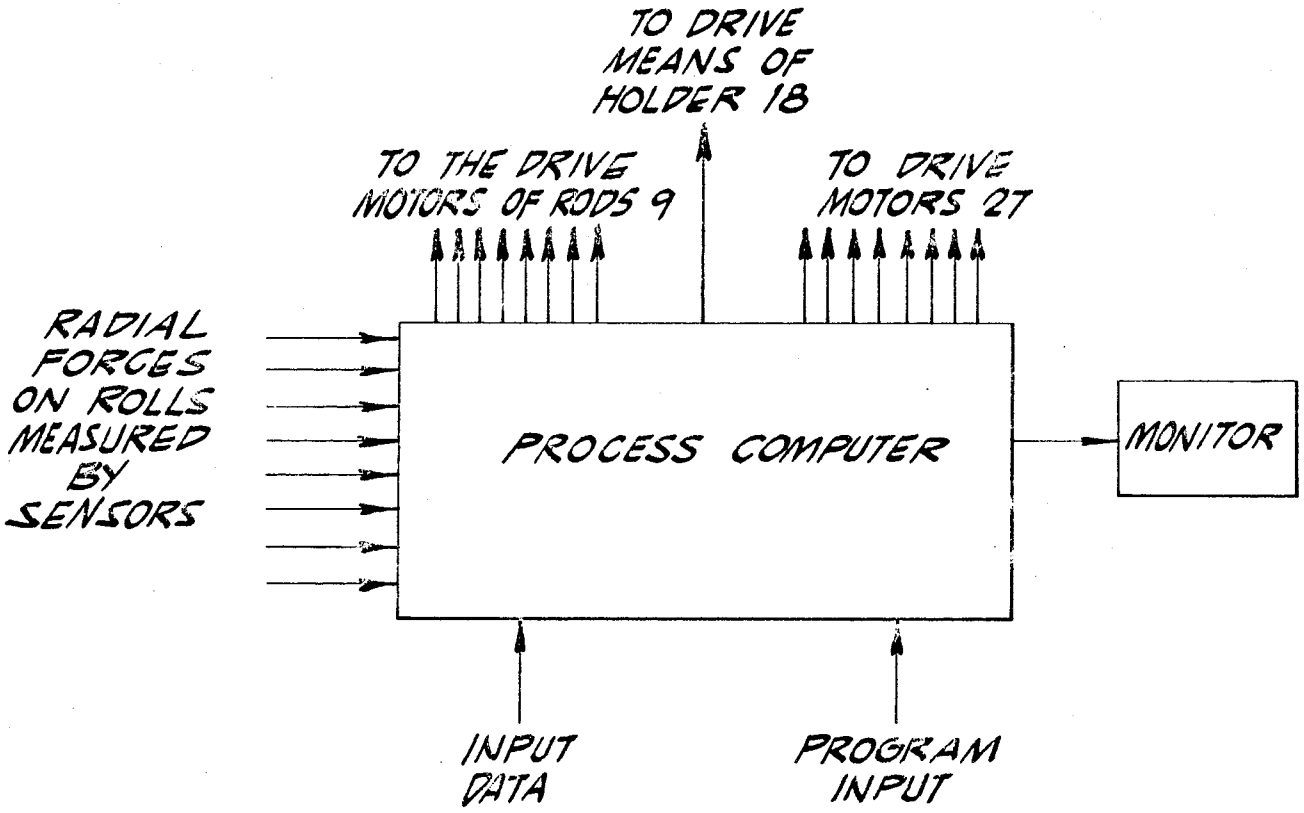

FIG. 8 shows automatic control system which comprises a process computer which as input data receives the roll diameter, the external and internal diameters of the workpiece 5 and the radial feed amounts as per the table of FIG. 6. The process computer then calculates from such data the radial positions to be moved into. The lathe is then set to such positions. After the calculated positions have been reached the set working and roll diameters and the working gap of the rolls of the four pairs 1, 2, 3 and 4 are indicated on a monitor, compared with the target values and registered. The ensuing motion of the rolls into the workpiece 5 they requires further program steps for the radial feed.

The engagement of the rolls with the workpiece 5 via a previously turned or machined taper is the simplest method in order to load each roll with practically the same thrust and with the same metal working effect if there is no excessive formation of beads.

The timing of the setting of the lathe and the timing of the spinning process may be represented as follows in the case of the use of an initial taper: the accurate fixing of the workpiece 5 is checked by measuring for wobble and eccentric running, while the axial and radial positioning of the rolls correspond to the given values. The speeds of the workpiece 5 and of the rolls are now synchronized and the roll carriers are moved into position. Lastly the cooling water system, the systems for measuring the wall thickness and the diameters are the last parts to be checked. When the axial thrust applying means for the roll carriers is turned on the spinning process is commenced.

During the process the first step is for all the roll pairs 1, 2, 3 and 4 to be moved without changing the radial position of their rolls towards the initial taper. Then the rolls of the roll pairs 1, 2 and 3 run along the initial taper 33 and 34 onto the workpiece 5. As soon as the rolls 3/1 and 3/2 of the third roll pair 3 have reached the workpiece 5, the radial thrust measuring device will respond and the radial feed device for the rolls 4/1 and 4/2 of the fourth roll pair 4 is turned on. This feed may for instance be equal to 6 mm/min. During the engagement phase in the selected example the roll pair 4/1 and 4/2 will have to come into engagement 1 mm deeper. The rolls 2/1 and 2/2 of the second roll pair are not moved radially during the engagement phase. Accordingly their speed of radial feed is zero. If now a radial thrust differential becomes established between the inner and/or outer rolls of the roll pairs 1 and 2 and, respectively, between the inner and/or outer rolls of the roll pairs 3 and 4 such that this differential exceeds the given limit value of for instance 80 kN, this signal will act via the automatic control system to cause a compensatory radial motion of the respective rolls of the roll pair 1 and/or 3. The speed of radial adjustment will for instance be 12 mm/min. These relatively high speeds of radial adjustment of the rolls of the roll pairs 1 and 3 are needed in order to achieve a rapid compensation of the differential thrust.

At the end of the work engaging phase, that is to say when the rolls 4/1 and 4/2 of the fourth roll pair 4 have reached their radial end position, the rolls 2/1, 2/2 and 4/1, 4/2 of the roll pairs 2 and 4 are only radially reset for a correction of the wall thickness and diameter and in the case of any malfunction of the system.

In the case of this manner of engaging the relevant operation parameters—displacement and speed—for the rolls of the roll pairs 2 and 4 are fixed apart from the wall thickness and diameter correction. The automatic control operation subject to the differential force is thus in accordance with the invention limited to the roll pairs 1 and 3. Since the rolls of the roll pair 2 and 4 receive a set control command, the interaction of control between the individual rolls is stabilized. The second roll pair 2 effects a preliminary working to the required size whereas the fourth roll pair 4 performs the final working to the required size as regards the wall thickness of the tube to be produced. This automatic control operation offers the advantage that for instance in the case of an unforeseen substantial bead formation the respective roll will penetrate 50% less and will thus decrease further formation of bead. The larger amount of work on the material owing to bead formation is performed to an equal extent by the roll pairs 1 and 2. Generally the work on the material is performed so as to be divided equally between the roll pairs 1 and 2 and between the roll pairs 3 and 4. This will also apply when malfunction occurs owing to unforeseen behavior of the material and/or errors in the setting of the rolls and/or in programming the rolling operation. This principle of equal division of work on the material or deformation thereof between the oppositely placed roll pairs 1 and 2 on the one hand and 3 and 4 on the other hand may also be applied in the same manner in the case of workpieces 5 which have not undergone preliminary turning so that the workpiece would then not have any initial taper and in fact be tubular at this end.

The engagement operation for the rolls in case of a workpiece 5 without any such preliminary machining to produce a taper will now be explained with reference to FIGS. 5A through 5B.

For the size determining roll pairs 2 and 4 the radial feed rates with respect to the radial end positions of the rolls 2/1, 2/2, 4/1 and 4/2 are firstly supplied to the process control computer.

The rolls of the roll pairs 1 and 3 subject to differential force will radially penetrate the workpiece 5. This means that at every point in time in the engagement phase there will be an equal division of the deforming or working forces between the opposite placed rolls. The time of switching on radial feed will coincide with the time of switching on the axial feed.

FIGS. 5A to 5D show the axial and radial positions of the outer rolls 1/2 and 2/2 of the roll pairs 1 and 2. FIGS. 5E through 5H additionally show the axial and radial positions of the rolls 3/2 and 4/2 of the roll pairs 3 and 4 during the phase of engaging the workpiece 5. The respective inner rolls are not shown since operation is in synchronism, that is to say the conditions of operation, which will be described below in connection with one outer roll, are the same for the inner roll, operating as an opposite or abutment roll, of the respective pair of rolls.

In the FIGS. 5A through 5H the entry into working engagement and further motion of the individual rolls on the workpiece 5 is indicated by broken arrows.

Figure 5A:
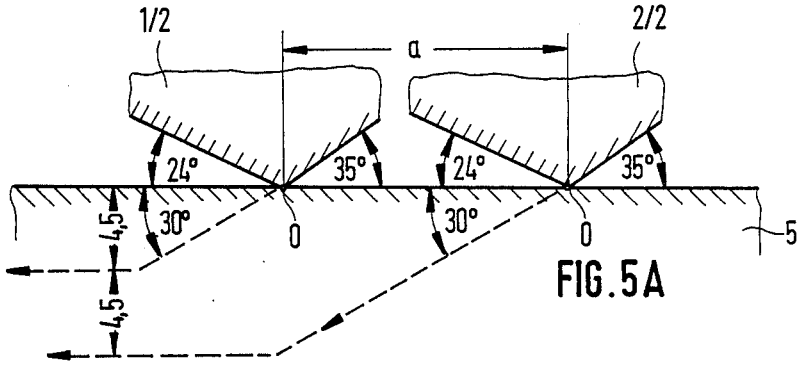
FIGS. 5A to 5H show the motion of the rolls of the opposed roll spinning lathe into the rolling setting in the case of a workpiece which has not been tapered by previous turning and is internally and externally cylindrical.

In the FIG. 5A the geometrical features, the depth of penetration, the working angle, the angle of entry into working engagement and the axial roll spacing a are indicated at the point in time 0 of the said phase of entry into working engagement. In this respect a particularly important part is played by the value set for the axial roll spacing a. If the setting for this distance a is not large enough, the point of intersection 0 indicated in FIG. 5B of the working faces of the two outer rolls 1/2 and 2/2 of the roll pairs 1 and 2 would be achieved relatively early and after only a small radial penetration. If the setting for the distance were to be too large, this might cause the roll 1/2 to run into the radial end position simultaneously with the roll 2/.2. In either case this would mean that during the phase of coming into working engagement the rolls 1/2 and 2/2 of the two first roll pairs 1 and 2 would, in relation to the later stationary process, perform an insufficient or excessive amount of work on the material. Then at the latest by the time the roll 2/2 of the second roll pair 2 would come into working engagement with the part of the tube already finished by the roll 1/2 of the first roll pair 1, there would suddenly be a relatively massive increase in the differential force, which in some cases would not be able to be compensated for by the roll 1/2 and as a result the spinning operation would be interrupted.

The axial spacing a of the rolls is generally so set that the point of intersection of the two working faces of sequentially arranged rolls occurs when the roll 1/2 and, respectively, 3/2 has reached the respective calculated radial end position. For, as will be gathered from the FIGS. 5B, 5C, 5D, 5F, 5G and 5H the, there is only a modification of the forces at the rolls 2/2 of the second roll pair 2 and 4/2 of the fourth roll pair 4 after running through the line of intersection of the working faces only in the case of the transitional zones. These brief modifications in force are compensated by an immediate force-equalizing reaction of the rolls 1/2 and, respectively, 3/2 on further radial penetration of the rolls 2/2 and, respectively, 4/2.

Figure 5B:
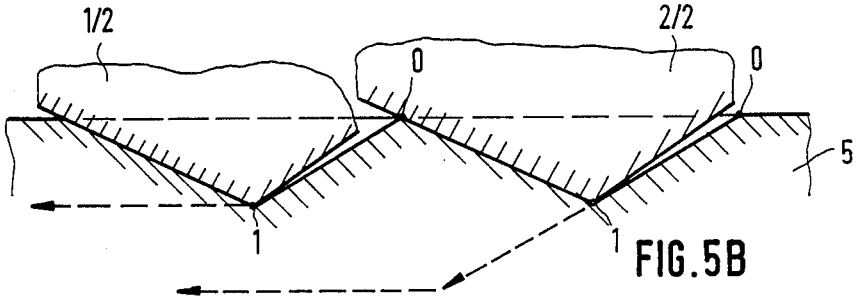

FIG. 5B shows the penetration of the outer rolls 1/2 and 2/2 of the two first roll pairs 1 and 2 into the workpiece 5 at that moment in time, at which the working face of the roll 2/2 intersects that of the roll 1/2 at the point 0. As from this point in time and during further penetration of the roll 2/2 the radial force remains substantially constant in accordance with the broken line. Owing to the differential force control the roll 1/2 only penetrates the workpiece 5 a small amount and remains more or less at a constant radius—see the broken arrow line.

Figure 5C:
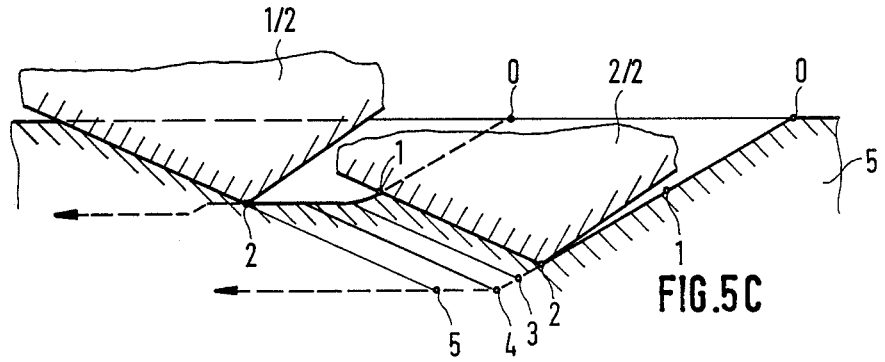

FIG. 5C shows the further development of the working face of the roll 2/2. Since the radial force is proportional to the working area and the latter depends on the depth of penetration, the lathe feed and the "workpiece" feed, any alteration in this area will always lead to a compensatory motion of the roll 1/2 via the measurement of differential force.

Figure 5D:
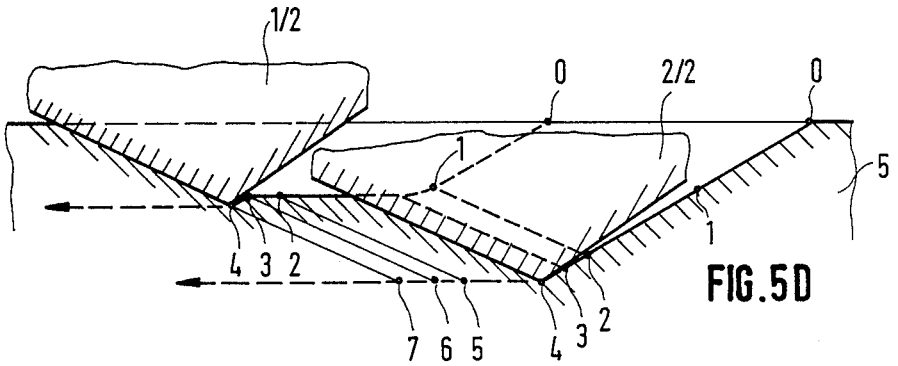

FIG. 5D shows the radial and axial motion of the roll 1/2 till it reaches the radial end position of the roll 2/2. In this case the roll 2/2 is shown in the radial end position, the roll 1/2 only having to perform small radial corrections.

Figure 5E:
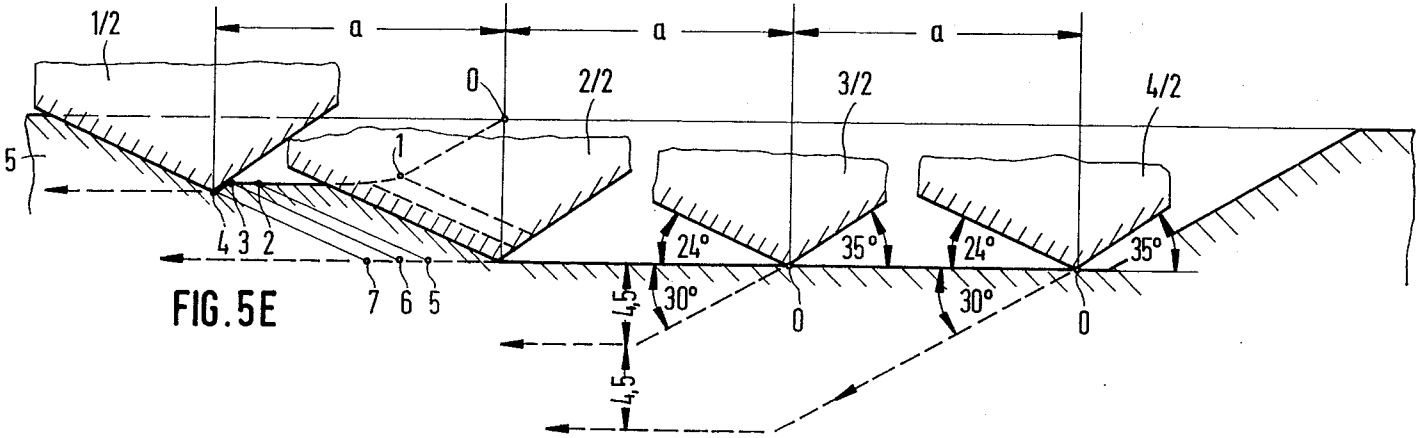

FIG. 5E shows the radial feed of the outer rolls 3/2 and 4/2 of the third and fourth roll pair 3 and, respectively, 4 towards the outer face of the workpiece 5 as arises in the direction of stretch following the outer roll 2/2 on the workpiece 5.

Figure 5F:
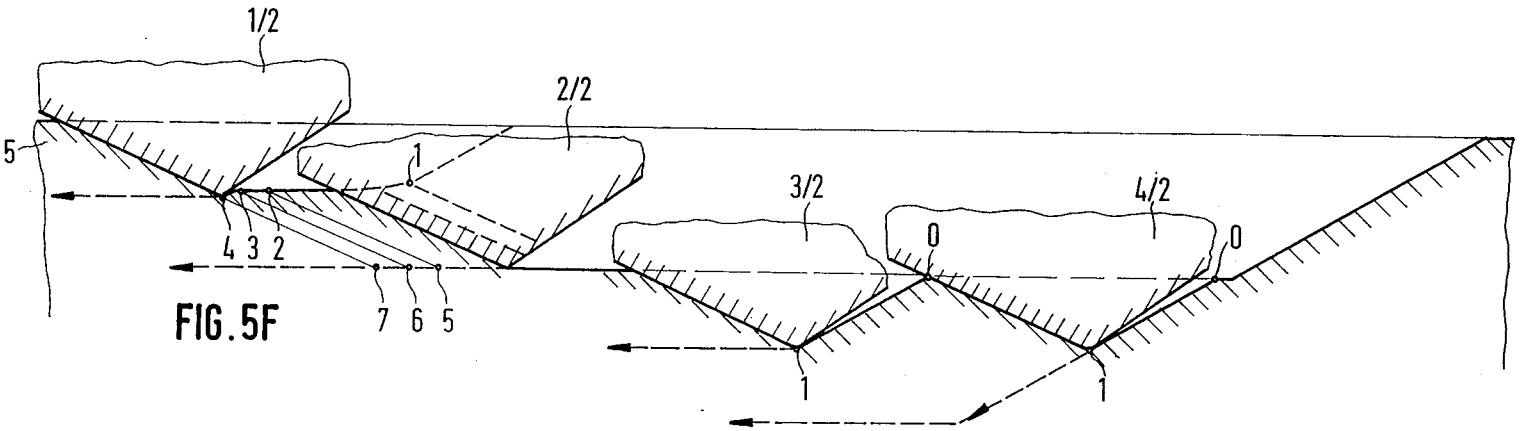
Figure 5G:
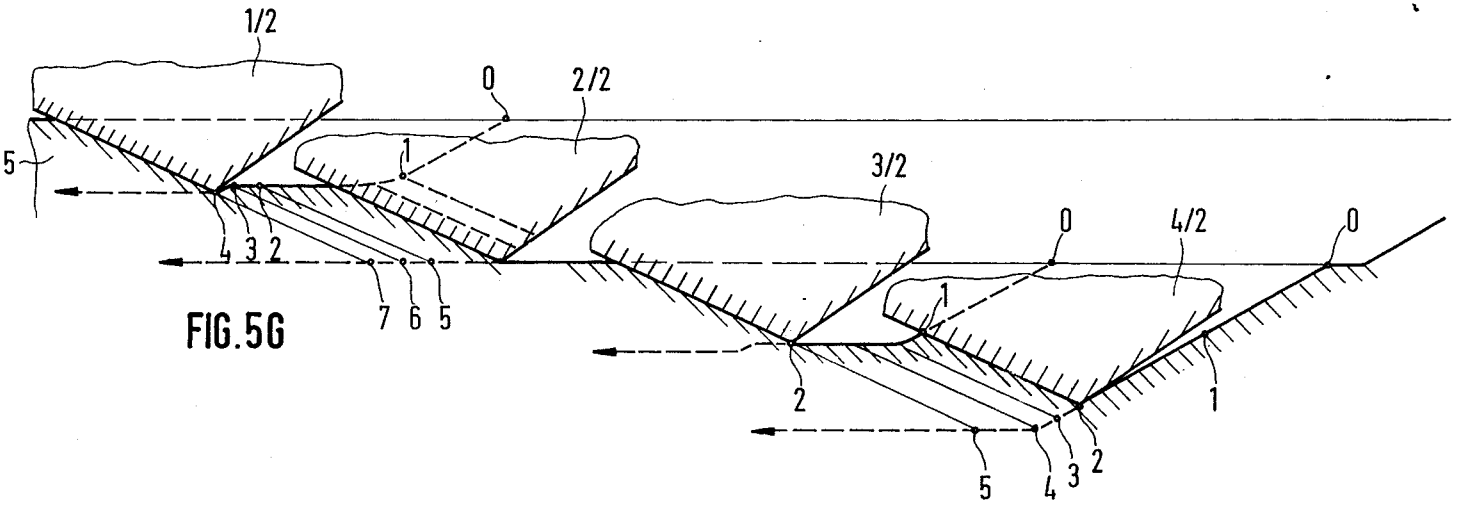
Figure 5H:
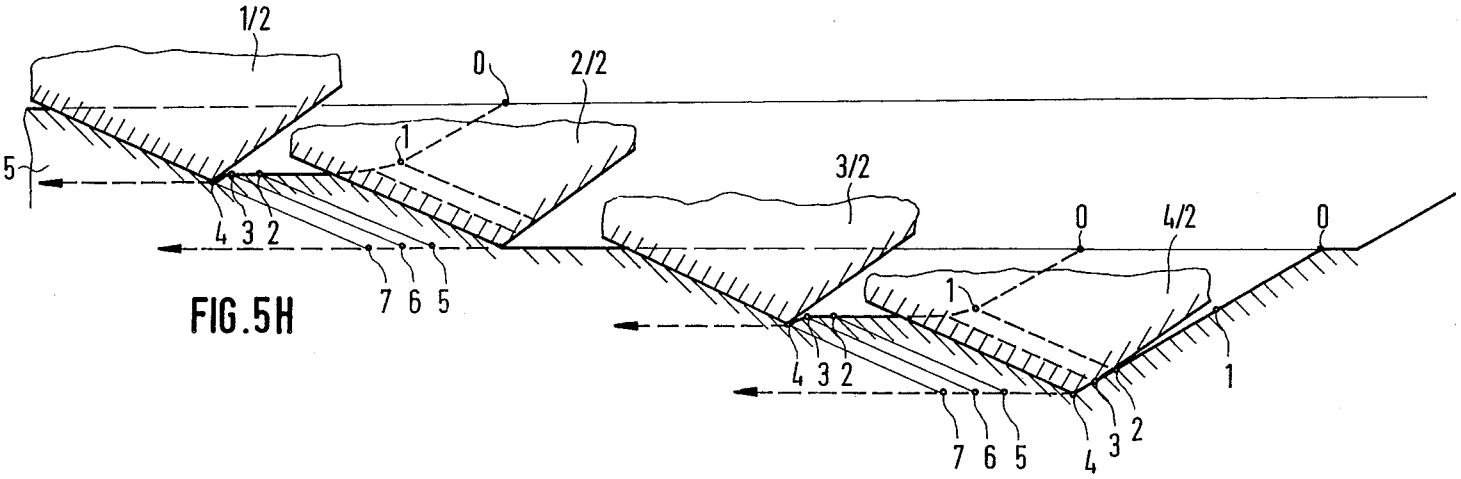

FIGS. 5F, 5G and 5H show the coming into working engagement of the outer rolls 3/2 and 4/2 with the workpiece 5, this taking place in the same manner as the coming into working engagement of the rolls 1/2 and 2/2 as in FIGS. 5B, 5C and 5D so that no further description is needed.

In FIG. 5H the rolls 2/2 and 4/2 have reached their radial end positions. Corrections to equalize the differential force are henceforth only performed for compensation of the stationary rolling process by the rolls 1/2 and 3/2.

During the stationary working of the workpiece being converted into a tube the wall thickness and diameter are measured. Departures from the intended value will then lead to corresponding wall thickness and/or diameter corrections.

It is only the rolls 4/2 and 4/1 of the fourth pair of rolls 4 which participate in a wall thickness correction. For wall thickness differences in excess of 0.2 mm (i.e. representing a departure of more than 0.2 mm from the intended value) the rolls 4/2 and 4/1 are each radially shifted by the same proportional amount. For the compensation of wall thickness deviations between 0.07 mm and 0.20 mm only the inner roll 4/1 of the roll pair 4 is shifted by the differential amount.

A correction of the wall thickness by feed of the rolls 4/2 and 4/1 of the fourth roll pair 4 is detected by the respective measuring sensor with a delay in time which is required by the workpiece to move the distance between the fourth roll pair and the measuring sensor. It is thus necessary to disenable the automatic control of wall thickness by means of the fourth pair of rolls 4 for this time or, respectively, for this distance, which may be detected by the length measuring device. This means that the fourth roll pair 4 may only perform a correction in wall thickness after certain rates of growth in the length of the workpiece, which are larger than the distance from the measuring sensor to the operating point of the fourth roll pair 4. The first wall thickness correction is performed when the rolls 4/2 and 4/1 of the fourth roll pair 4 have reached their as-programmed end positions and the worked part of the workpiece has reached the respective measuring sensor with the allowance of a certain length for safety.

A correction of diameter is performed, for example, when the departure in diameter exceeds at least half the tolerance set. The point in time for shifting of the roll is precisely between two wall thickness corrections.

A diameter correction is commenced by shifting the rolls of the fourth and of the second roll pairs 4 and 2. The distances to be corrected result from the measured departure $\Delta D$ of the respective internal and external diameters on the rolled tube. In the case of the rolls 2/1 and 2/2 of the second roll pair 2 these corrections amount to $1/4 \cdot \Delta D$ and for the rolls 4/1 and 4/2 of the fourth roll pair 4 they amount to $1/2 \cdot \Delta D$ and are imparted to each roll with the appropriate prefix (+) or (−). The rolls of the roll pairs 1 and 3 are caused to follow the shift via the differential force compensation control system.

Irrespectively of the radial motions caused by the control system of the rolls when coming into working engagement with the workpiece with or without an initial taper and irrespective of the diameter or wall thickness corrections, in the case of malfunction the axial feed is always discontinued and there is a simultaneous motion of all spinning rolls out of their operating positions. Malfunction is always considered to take place when the difference between the radial forces at two rolls to be compared exceeds the present limit of, for instance, 150 kN. The same applies when the radial force at some position reaches an absolute value of for instance 1700 kN, or when in the feed direction the limit values for the axial forces are exceeded. When the maximum permissible drive moment of for instance 900 kNm is exceeded the feed drive and the main drive is switched off and all the spinning rolls are moved out of their operating positions.

In order, as far as possible, to avoid premature interruptions in the spinning operating as a result of incorrect setting of the rolls or of the rolling process parameters or in the case of malfunction, it may be possible to provide for manual correction of the roll settings during the course of rolling.

If, for instance, one roll of the second and fourth pair of rolls is subjected to a radial force of 1550 kN, the radial motion of the respective roll is halted and if there is a further increase in the force, the roll is radially retracted. At the same time an acoustic warning signal will be produced, which lets the operator know that he has an opportunity of seeing what the error is and carrying out correction by a manual operation in accordance with a special set of instructions. If these measures do not lead to the desired effect, then when the radial force reaches said value of 1700 kN the feed is switched off and all the spinning rolls are moved out of their working positions.

By way of conclusion a brief description of a measuring device for the radial forces acting on the rolls is given hereinafter. One example is diagrammatically shown on a larger scale in FIG. 7 as part of FIG. 3 in conjunction with the roll 1/1, it having to be noted that the conditions are identical or comparable at all the other rolls.

As may be seen from FIG. 7, the roll 1/1 is secured to a shaft 37, which is rotatably mounted in bearing means 31. The bearing means are preferably in the form of self-aligning non-friction bearings 38 and 39, which do not substantially impede the bending of the shaft 37 during rotation and prevent excessive edge pressures when the shaft 37 bends. The shaft 37 is hollow and in its cavity a coaxial rod 40 is accommodated. The latter is joined to the shaft 37 where its angle of flexure is greatest, while its free end extends from the shaft 37 and is arranged to cooperate with a sensor 41 attached in the bearing means 31. The shaft 37 is so constructed that the cross section within the field of action of radial forces allows detectable elastic flexure over the entire radial force range which is to be measured. The bearing means for the shaft 37 are such that its maximum possible flexure is not impeded. The measuring rod 40 fixedly connected to the shaft is so designed that in the position of fixation it detects the angle of shaft bend and at the opposite free end will be subject to a deflection x which is substantially increased along the measured length and this deflection will be detected by the sensor 41 in order to measure the value. The radial force F is thus able to be converted, despite the rotation of the transmission elements, as a quasi-static deflection x and thus may be measured in the form of a distance. The measuring rod 40 may be made with a taper so that its cross section and mass or moment of inertia per unit length decrease. It may be provided with passive or active damping elements. In lieu of a single sensor 41 it is possible to provide a number of them. The distance between the sensor or sensors 41 and the measuring rod 40 is detected without making physical contact, is converted into a data signal and then supplied to the automatic control system.

What is claimed is:

1. A method for the automatic control in a spin rolling process of the set positions of spinning rolls in relation to a cylindrical, tubular workpiece in an opposed roll spinning lathe, said method comprising arranging first, second, third and fourth pairs of rolls in the spinning lathe in successive, axially spaced relation to form respective first, second, third and fourth rolling stages, each roll pair consisting of one inner roll and one outer roll, supporting each roll on a holder on a carrier so as to be radially adjustable in relation to the workpiece, said pairs of rolls being arranged at an equal circumferential spacing about the workpiece with the roll pair of the first rolling stage placed diametrically opposite the roll pair of the second rolling stage, the roll pair of the third rolling stage being angularly offset by 90° in relation to said first roll pair and being diametrically opposite the roll pair of the fourth rolling stage, relatively displacing, during the spin rolling process, the pairs of rolls and the workpiece to produce relative translatory and rotary motion therebetween, continuously measuring the radial forces acting on the rolls during their displacment to their initially set positions and during the spin rolling process, comparing the radial forces at corresponding rolls of the respective opposite pairs of rolls and if a permissible differential force is exceeded radially displacing the roll of the preceding roll stage to compensate for lack of force equilibrium while keeping the other roll of said corresponding rolls in its initial radial position.

2. The method as claimed in claim 1 comprising reducing a feed rate which determines relative axial motion between the workpiece and the rolls when a second radial differential force is higher than said permissible differential force.

3. The method as claimed in claim 2 comprising interrupting the spin rolling process and disengaging said rolls from the workpiece when said second radial force load limit is exceeded by a determined amount.

4. The method as claimed in claim 1 wherein automatic control of the wall thickness of the workpiece is exclusively performed by modifying the radial position of the rolls of the fourth roll pair.

5. The method as claimed in claim 4 wherein in the case of a deviation in the wall thickness of the workpiece in excess of 0.2 mm from a desired value therefor, said deviation is corrected by resetting the radial positions of inner and outer rolls of the fourth pair by amounts equal to half the amount of a correction for the deviation.

6. The method as claimed in claim 4 wherein in the case of a deviation in the wall thickness of the workpiece of less than 0.2 mm from a desired value therefor, said deviation is corrected by resetting the radial position only of the inner roll of the fourth pair by an amount equal to half the amount of a correction for the deviation.

7. The method as claimed in claim 4 comprising effecting correction of wall thickness of the workpiece at certain intervals with a timed sequence exceeding the time elapsing between the point in time of resetting the position of the rolls and the point in time of detecting a resulting correction.

8. The method as claimed in claim 7 comprising effecting correction of the diameter of the workpiece in periods when no correction of wall thickness is being effected.

9. The method as claimed in claim 8 wherein any necessary diameter correction is commenced simultaneously by the rolls of tihe second and fourth roll pair with radial displacements in the following amounts:

rolls of the second, $1/4 \times D$ and
rolls of the fourth pair, $1/2 \times D$, D denoting the departure from the desired value of the diameter.

10. The method as claimed in claim 9 comprising causing the rolls of the first and of the third pairs of rolls to participate in the correction of diameter of the workpiece by the automatic control of differential force.

11. The method as claimed in claim 9 comprising limiting correction to maximum permissible radial forces so that the diameter correction is only performed when the permissible radial forces have not been exceeded.

12. The method as claimed in claim 1 wherein when the permissible differential force is exceeded between the compared rolls, the force will be higher in one roll and lower in the other roll and when said one roll is the inner roll, the inner roll of the preceding stage will be radially adjusted while the inner roll of the subsequent stage will be maintained in its initial radially set position whereas when said one roll is the outer roll, the outer roll of the preceding stage will be radially adjusted while the outer roll of the subsequent stage will be maintained in its initial radially set position.

13. The method as claimed in claim 12 comprising wherein the differential radial forces are measured on corresponding inner and outer rolls of the opposite pairs of rolls.

14. The method as claimed in claim 1 comprising measuring the radial forces acting on the rolls during their radial displacement to their initial set positions when they come into engagement with the workpiece as well as during the spin rolling process.

* * * * *

UNITED STATES PATENT AND TRADEMARK OFFICE

CERTIFICATE OF CORRECTION

PATENT NO. : 4,951,490

DATED : August 28, 1990

INVENTOR(S) : Heinz GRONERT and Manfred ECKERT

It is certified that error appears in the above-identified patent and that said Letters Patent is hereby corrected as shown below:

On the title page:

Item 73 - Correct the printing of the Assignee name from:

"Man Technologie GmbH, Munich" to

--MAN TECHNOLOGIE GmbH, Munich--.

Signed and Sealed this

Twenty-seventh Day of April, 1993

*Attest:*

MICHAEL K. KIRK

*Attesting Officer*

*Acting Commissioner of Patents and Trademarks*